United States Patent [19]

Divers et al.

[11] 4,383,726

[45] May 17, 1983

[54] ELECTRIC TERMINAL

[75] Inventors: Raymond T. Divers, Camillus; Thomas L. Kassouf, East Syracuse, both of N.Y.; Joan Circelli, Arlington, Tex.

[73] Assignee: Carrier Corporation, Syracuse, N.Y.

[21] Appl. No.: 219,040

[22] Filed: Dec. 22, 1980

[51] Int. Cl.[3] ..... H01R 9/18

[52] U.S. Cl. ..... 339/198 R

[58] Field of Search ..... 339/198 R, 198 C, 126 RS

[56] References Cited

U.S. PATENT DOCUMENTS

| | | | |
|---|---|---|---|
| 2,778,904 | 1/1957 | Jacobi | 339/198 C X |
| 2,998,589 | 8/1961 | Kulka | 339/198 R |
| 3,860,314 | 1/1975 | Vandiveer et al. | 339/198 R X |
| 3,953,099 | 4/1976 | Wilson | 339/126 RS X |
| 4,037,912 | 7/1977 | Besser et al. | 339/198 R |

*Primary Examiner*—Howard N. Goldberg

*Attorney, Agent, or Firm*—Donald F. Daley; David J. Zobkiw

[57] ABSTRACT

An electric terminal comprising a body, a plurality of terminal pins and terminal nuts, a pin retainer, and retainer connecting apparatus releasably connecting the pin retainer to the terminal body. The terminal pins longitudinally extend through the body, and the terminal nuts encircle and engage upper portions of the terminal pins and are held thereby in pressure contact agains the body. The pin retainer longitudinally extends between terminal pins to insulate electrically the pins from adjacent pins, and transversely extends over the terminal nuts to maintain the terminal nuts and the terminal pins in place. The terminal pins longitudinally extend above the transversely extending portion of the pin retainer to provide access to the terminal pins.

10 Claims, 4 Drawing Figures

FIG. 1
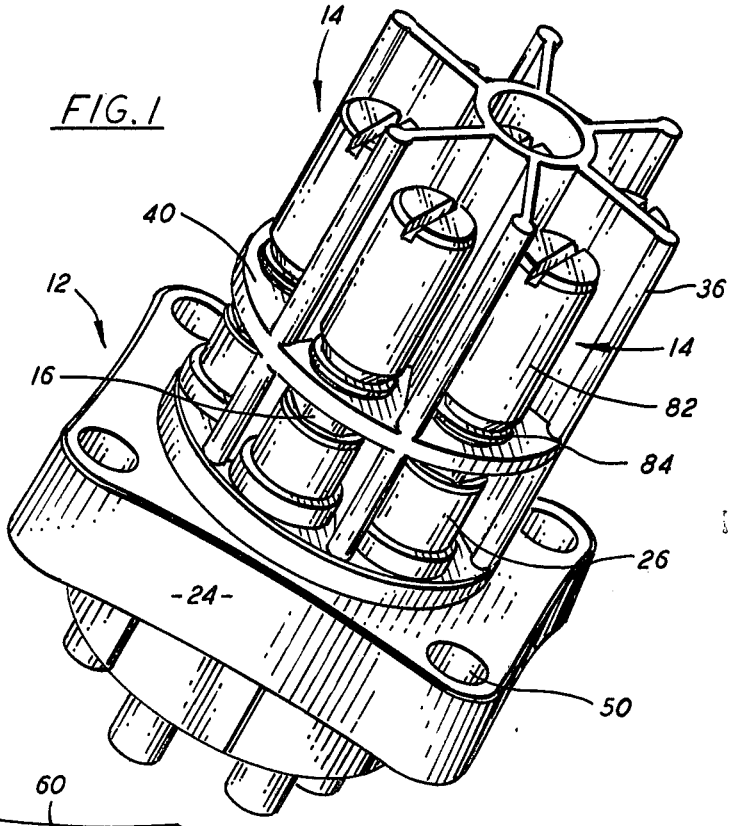
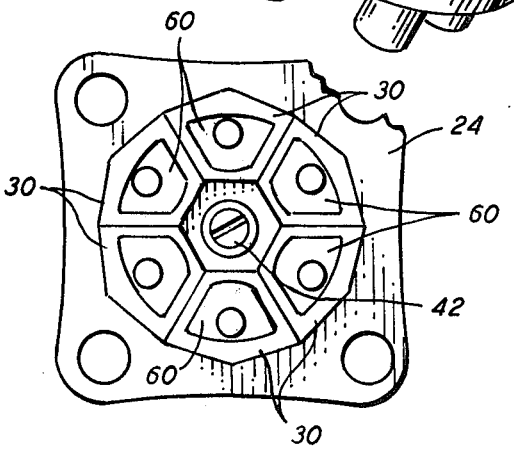
FIG. 4

ELECTRIC TERMINAL

BACKGROUND OF THE INVENTION

This invention generally relates to electric terminals, and more specifically to electric terminals employed to deliver electric power from an external source thereof to electrical conductors disposed within a shell of an electrically operated apparatus.

Electric terminals are often used to conduct an electric current from an external source to a plurality of electrical conductors located inside a shell or housing of an electrically driven apparatus, for example a hermetically or semi-hermetically sealed compressor. Such terminals commonly comprise a body and a plurality of terminal pins longitudinally extending through the body. The body, in turn, includes a metallic mounting plate and plurality of electrically nonconductive pieces. The mounting plate is used to secure the electric terminal to the shell or housing of the electrically operated apparatus; and the electrically nonconductive pieces extend above, below, and within the mounting plate and substantially enclose central portions of the terminal pins to insulate electrically the pins from each other, the mounting plate, and the shell or housing.

In many instances it is necessary to prevent fluid flow through the electric terminal. For example, if the terminal extends through the shell of a hermetically or semi-hermetically sealed compressor filled with vapor at greater than ambient pressure, it is necessary to prevent vapor leakage from the interior of the shell through the electric terminal. For this reason, the different pieces comprising the terminal may be compressed together into fluid tight, pressure contact. This pressure contact may be achieved by longitudinally compressing the body of the terminal inward between top and bottom elements connected to or forming a part of the terminal pins. For example, the terminal pins may include bottom, transversely extending flange portions, and the body of the electric terminal may be compressed between these flanges and a plurality of nuts threadably engaging upper portions of the terminal pins and held thereby in pressure contact against the top surface or surfaces of the body.

In this manner, the various pieces comprising the body are securely held together and brought into pressure contact with each other and with the terminal pins, retarding fluid flow along adjacent surfaces of the electric terminal. Moreover, the terminal pins themselves are securely held in place relative to the body of the terminal. Despite this pressure contact, however, if the electric terminal is subjected to abusive conditions, water or other contaminants may leak into the electric terminal, and these contaminants may cause electrical arcing between central portions of the terminal pins and the mounting plate. This arcing may corrode central portions of the terminal pins, and eventually a terminal pin may break into two separate pieces.

With the above-described type of electric terminal, where the pieces of the terminal body are compressed together between elements connected to or forming a part of the top and bottom portions of the terminal pins, if the central portion of a terminal pin breaks, the forces holding the terminal body together are reduced. Consequently fluid may more readily leak into the terminal, particularly in the area of the broken pin. If the electric terminal is employed with a compressor filled with vapor at greater than ambient pressure, the vapor may leak into the terminal and thence force the broken pieces of the pin out of the terminal. When this happens a relatively large leak path is established through the terminal and the vapor within the compressor may escape through this leak path, eventually resulting in a nearly complete loss of vapor.

SUMMARY OF THE INVENTION

In view of the above, an object of the present invention is to improve electric terminals.

Another object of this invention is to maintain the top portions of a terminal pin of an electric terminal in position even if the terminal pin breaks, and to accomplish this without preventing or hindering access to the terminal pin during normal operation of the electric terminal.

A further object of the present invention is to prevent outward movement of the terminal pins of an electric terminal with a pin retainer that is releasably connected to the body of the electric terminal.

These and other objectives are attained with an electric terminal comprising a body, a plurality of terminal pins and terminal nuts, a pin retainer, and connecting means releasably connecting the pin retainer to the terminal body. The terminal pins longitudinally extend through the body, and the terminal nuts encircle and engage upper portions of the terminal pins and are held thereby in pressure contact against the terminal body. The pin retainer longitudinally extends between terminal pins to insulate electrically the pins from adjacent pins, and transversely extends over the terminal nuts to maintain the terminal nuts and pins in place. The terminal pins longitudinally extend above the transversely extending portion of the pin retainer to provide access to the terminal pins.

A BRIEF DESCRIPTION OF THE DRAWINGS

FIG. 1 is a front perspective view of an electric terminal constructed in accordance with a preferred embodiment of the present invention;

FIG. 4 is a bottom view of the terminal shown in FIGS. 1 through 3.

A DETAILED DESCRIPTION OF THE PREFERRED EMBODIMENT

Figure 3:
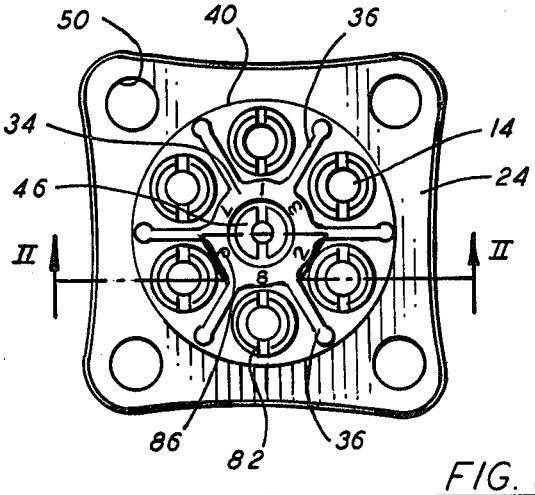
FIG. 3 is a top view of the electric terminal shown in FIGS. 1 and 2.

The present invention relates to electric terminals which may be employed in various applications wherein electrical power is transmitted via the terminal from a remote source of power to electrically conductive leads provided within the housing or shell of an electrically operated apparatus. Typical of the foregoing is the utilization of an electric terminal with a hermetically or semi-hermetically sealed refrigerant compressor driven by an electric motor.

Referring now to the drawings, there is illustrated electric terminal 10 designed to deliver electrical power from an external source thereof to electrical leads disposed within a shell of a compressor (not shown). Terminal 10 comprises, generally, body 12, a plurality of electrically conductive terminal pins 14, a plurality of terminal nuts 16, pin retainer 20, and connecting means 22 releasably connecting the pin retainer to body 12. More specifically, with particular reference to FIG. 2, body 12 includes mounting plate 24, outer block 26, a plurality of inner blocks 30, and a plurality of gum rubber bushings 32; and pin retainer 20 includes core portion 34, a plurality of fins 36, and a transversely extending planar portion 40. Moreover, connecting means 22 preferably includes connecting pin 42, outer block nut 44, and retainer nut 46.

Mounting plate 24, which may be formed of aluminum or another suitable metal, is used to secure terminal 10 to the shell or housing of a compressor in any conventional manner. For example, plate 24 may define a plurality of bolt holes 50, and the mounting plate, and thus terminal 10, may be secured to the compressor shell by threading bolts through holes 50 and into tapped holes or similar apertures in the compressor shell.

Outer block 26 and inner blocks 30 are formed of electrically nonconductive material, for example a phenolic material, and are located above and below mounting plate 24 respectively. Mounting plate 24, outer block 26 and inner blocks 30 respectively define a plurality of aligned apertures 52, 54, and 56, and terminal pins 14 longitudinally extend through these aligned apertures. As is believed best understood from FIG. 3, terminal pins 14 and apertures 52, 54, and 56 are circumferentially spaced along a circle about the longitudinal centerline of body 12. Bushings 32 are disposed within apertures 52 of mounting plate 24, longitudinally extend substantially between outer block 26 and inner blocks 30, and encircle the portions of terminal pins 14 extending therebetween.

Body 12 is longitudinally compressed together between terminal nuts 16 and flange portions 60 of terminal pins 14. More particularly, transversely extending flange portions 60 of pins 14 are located below and abut against bottom shoulder surfaces 62 of inner blocks 30. At the same time, terminal nuts 16 encircle and threadably engage upper portions of pins 14 and are held thereby in pressure contact against top surfaces of outer block 26. As is conventional, washers 64 may be disposed between nuts 16 and the top surface of outer block 26. Thus, nuts 16 and flanges 60 securely hold together the various pieces of body 12 and securely hold pins 14 in place relative to the body.

Figure 2:
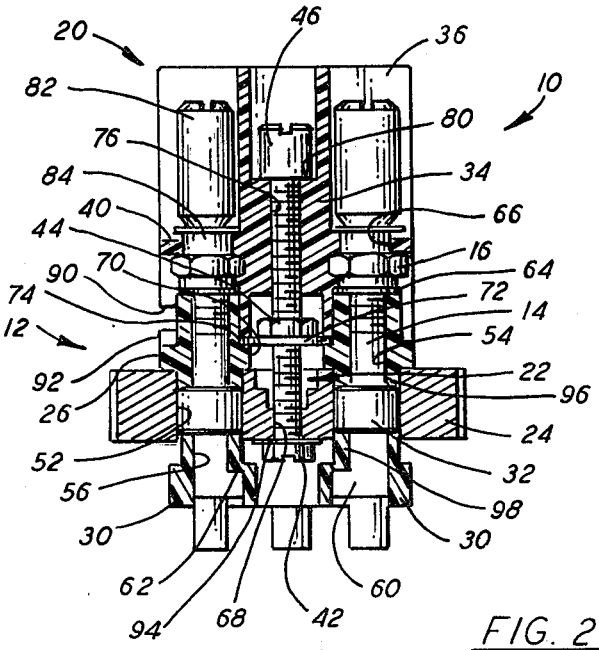
FIG. 2 is a sectional view of the terminal shown in FIG. 1 taken along line II—II of FIG. 3.

Pin retainer 20 longitudinally extends between terminal pins 14 to insulate electrically the pins from adjacent pins, and transversely extends over terminal nuts 16 to maintain the terminal nuts and pins in place, even if the central portion of a terminal pin should break. More specifically, core portion 34 of pin retainer 20, which preferably is a single integral element also formed of a phenolic material, is disposed inside the circle defined by pins 14, and fins 36 radially extend outward from the core portion, between adjacent pins 14. Preferably, core 34 and fins 36 longitudinally extend from a height above the top of pins 14 to a location below the top surfaces of outer block 26, as shown in FIG. 2, providing a thorough, electrically insulating barrier between adjacent terminal pins, specifically upper portions thereof.

Transversely extending, planar portion 40 of pin retainer 20 radially extends outward from core 34 and is directly above at least a part of each terminal nut 16. Preferably, planar portion 40 radially extends past terminal nuts 16 and defines a plurality of apertures 66, with terminal pins 14 extending through these apertures. The diameter of apertures 66 is slightly larger than the diameter of terminal pins 14 but smaller than the outside diameter of terminal nuts 16. In this manner, pin retainer 20 does not bind against pins 14 as the pin retainer is longitudinally moved therealong. Nevertheless, even if terminal 10 is used with a compressor filled with relatively high pressure vapor and a central portion of any terminal pin 14 breaks, a sufficient amount of pin retainer material is located directly above the terminal nut 16 secured to the broken pin to prevent the compressor vapor pressure from forcing the nut through aperture 66. Hence, transverse portion 40 of pin retainer 20 holds the nut 16 which is secured to the broken terminal pin and, thus, the top portions of the broken terminal pin itself in place. This prevents the formation of any relatively large leak path through electric terminal 10 and substantially restricts any vapor flow through the aligned apertures 52, 54, and 56 previously occupied by the now broken terminal pin.

Connecting means 22, as previously mentioned, releasably connects pin retainer 20 to body 12, preferably to mounting plate 24 thereof. Further, with the preferred arrangement illustrated in the drawings, connecting means 22 also releasably connects outer block 26 to mounting plate 24. More particularly, a central portion of mounting plate 24 defines longitudinally extending, threaded aperture 68, and connecting pin 42 is threaded through this aperture and extends upward therefrom through central recess 70 of outer block 26. Washer 72 encircles pin 42 and rests on inside shoulder 74 of outer block 26. Outer block nut 44 threadably engages connecting pin 42 above and in pressure contact with washer 72, bringing this washer into pressure contact with shoulder 74 to hold outer block 26 against plate 24. At the same time, core 34 of pin retainer 20 is supported by shoulder 74 of outer block 26, either directly or via washer 72. Core 34 defines longitudinally extending aperture 76 aligned with aperture 68 of plate 24 and pin 42 also extends through aperture 76. Retainer nut 46 threadably engages connecting pin 42 and extends over shoulder 80 of core 34 in pressure contact therewith, holding pin retainer 20 against outer block 26.

Preferably, electric terminal 10 also includes adapters 82 threaded over top ends of terminal pins 14 to facilitate connecting the terminal pins to external electrical leads. As may be appreciated, it is desirable to secure tightly adapters 82 on pins 14. However, it is preferred to not tighten adapters 82 against transversely extending portion 40 of pin retainer 20 because this would tightly force the transverse portion 40 against nuts 16. Nuts 16 may not all be on the same level, for example, due to irregularities in outer block 26, or because one terminal nut is tightened to a greater or lesser extent than the other terminal nuts. If terminal nuts 16 are not level, then forcing transversely extending portion 40 of pin retainer 20 against the terminal nuts would generate bending forces in planar portion 40, which might produce cracks or breaks therein. For this reason, spacers 84 are provided extending through apertures 66, between terminal nuts 16 and adapters 82. In this manner, adapters 82 may be tightened against spacers 84, which are thus tightened against terminal nuts 16, without forcing planar portion 40 tightly against the terminal nuts.

It should be noted that the external leads which are secured to adapters 82 are often relatively heavy; and, with prior art electric terminals of the general type described above, when connecting an external lead to adapters 82, a mechanic or operator may pivot or swing a pin 14 away from its axially aligned position. This may increase the stresses on bushings 32, reducing their effective life span. With the preferred arrangement of pin retainer 20 described above, abutting contact between spacers 84 and the surfaces of the pin retainer defining apertures 66 assists maintaining pins 14 in their preferred axial alignment, thus helping to limit the stresses on bushings 32 and increasing the effective life span thereof.

In addition to the foregoing, with electric terminals of the general type described above, it is usually preferred that individual external electric leads be connected to a specific one of terminal pins 14. In view of this, pin retainer 20 may include identifying indicia 86 adjacent each terminal pin 14. In order to insure that each indicia 86 is properly matched with the correct pin 14, the lower portion of a selected fin 36 defines recess 90, and outer block 26 includes protrusion 92 extending upward between a selected pair of terminal pins. Protrusion 92 clearly indicates the terminal pins between which the fin defining recess 90 should extend; and, in fact, will allow pin retainer 20 to fit properly in terminal 10 only if the fin which defines recess 90 is placed between the same terminal pins as is the protrusion. These features produce a very simple yet highly effective arrangement for insuring that pin retainer 20 is properly positioned within terminal 10 and that indicia 86 are correctly matched with terminal pins 14. In order to insure that protrusion 92 itself is properly located within terminal 10, outer block 26 may include a downwardly extending, off-center pin (not shown) which fits into a mating pinhole (also not shown) extending downward from the top surface of and defined by mounting plate 24.

To assemble electric terminal 10, connecting pin 42 is threaded through aperture 68 of mounting plate 24, and outer block 26 is placed on the mounting plate, encircling the connecting pin. Sealing gasket 94 may be located between a head of pin 42 and the bottom surface of mounting plate 24 to prevent fluid flow through aperture 68, and preferably, outer block 26 includes sleeve extensions 96 adapted to fit closely within mounting plate apertures 52 to facilitate aligning the outer block. Washer 72 is placed on shoulder 74 of outer block 26, encircling connecting pin 42, and nut 44 is threaded downward along the connecting pin and tightened against washer 72, tightening the outer block against mounting plate 24. It should be noted that preferably outer block 26 is comprised of a single integral element, inter alia, to facilitate assembling terminal 10. However, outer block 26 could be comprised of a plurality of individual elements, for example with each aperture 54 defined by a separate piece. Inner blocks 30 and bushings 32 are placed on terminal pins 14, and then the terminal pins are inserted upward relative to mounting plate 24 through the mounting plate and outer block 26. Preferably, inner blocks 30 define sleeve extensions 98 also designed to fit closely within apertures 52 to assist aligning the inner blocks and to guide longitudinal movement thereof. Washers 64 are positioned on pins 14, and then terminal nuts 16 are threaded downward along the terminal pins into contact with outer block 26 via washers 64, and the terminal nuts are tightened thereagainst. As is believed best understood with reference to FIG. 4, preferably side surfaces of inner blocks 30 closely, but not tightly, fit together, generally forming a ring beneath mounting plate 24. In this manner, abutting contact between adjacent inner blocks 30 prevents rotation of the inner blocks and terminal pins 14 as nuts 16 are tightened about the pins and against body 12, while the inner blocks do not axially bind against each other.

As nuts 16 are tightened against outer block 26, inner blocks 30 are forced upward slightly, squeezing bushings 32 between the inner and outer blocks. Bushings 32 are squeezed into tight contact with both terminal pins 14 and the surfaces of mounting plate 24 defining apertures 52, forming a fluid tight seal between these surfaces and the terminal pins. A plurality of washers may be disposed immediately above and below bushings 32 to retard axial extrusion of bushing material between adjacent surfaces of mounting plate 24 and outer block 26 and between adjacent surfaces of the mounting plate and inner blocks 30.

Once nuts 16 are properly tightened, pin retainer 20 is placed in position. Specifically, apertures 66 and 76 are aligned with terminal pins 14 and connecting pin 42 respectively, and the fin defining recess 90 is aligned with protrusion 92. Pin retainer 20 is then moved downward along pins 14 and 42 until the bottom terminal edge of core 34 abuts against shoulder 74 of outer block 26 or washer 72. Retainer nut 46 is threaded downward along connecting pin 42 and tightened against shoulder 80, holding pin retainer 20 against body 12. Spacers 84 are placed on terminal pins 16 and then adapters 82 may be threaded on the pins and tightened against the spacers. Electric terminal 10 is now assembled and may be secured to the shell or housing of an electrically operated apparatus in any conventional manner.

Thus, as may be appreciated from a review of the above discussion, electric terminal 10 is relatively simple and inexpensive to construct and to assemble. At the same time, terminal 10 effectively maintains pins 14 and nuts 16 in plate even if the central portion of a pin should break, preventing the formation of a large fluid leak path through the terminal. Moreover, because pins 14 extend above transverse planar portion 40 of retainer 20, it is not necessary for a laborer or mechanic to remove retainer 20 in order to obtain access to the terminal pins. In contrast, pins 14 are easily accessible even when electric terminal 10 is completely assembled.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. An electric terminal comprising:

a body;

a plurality of terminal pins longitudinally extending through the body;

a plurality of terminal nut means, each terminal nut means encircling and engaging an upper portion of a terminal pin, located above an upper surface of the body, and held in pressure contact thereagainst by the pin wherein the body urges the terminal nut means and the upper portion of the terminal pin upward;

retainer means including a longitudinal portion and a transverse portion, the longitudinal portion extending between terminal pins to insulate electrically the pins from adjacent pins, the transverse portion extending above and over the terminal nut means to limit upward movement of the terminal nut means and the terminal pins, and wherein the terminal pins longitudinally extend above the transverse portion of the retainer means to provide access to the terminal pins; and connecting means releasably connecting the retainer means to the body.

2. An electric terminal as defined by claim 1 wherein:

the body includes a mounting plate, and outer block means extending above the mounting plate;

the terminal pins extend through the mounting plate and the outer block means; and the connecting means releasably connects the outer block means to the mounting plate.

3. An electric terminal comprising:

a body;

a plurality of terminal pins longitudinally extending through the body;

a plurality of terminal nut means, each terminal nut means encircling and engaging an upper portion of a terminal pin and held by the pin in pressure contact against the body;

retainer means including a longitudinal portion and a transverse portion, the longitudinal portion extending between terminal pins to insulate electrically the pins from adjacent pins, the transverse portion extending over the terminal nut means for maintaining the terminal nut means and the terminal pins in place, and wherein the terminal pins longitudinally extend above the transverse portion of the retainer means to provide access to the terminal pins;

connecting means releasably connecting the retainer means to the body, and including connecting pin means extending upward from the mounting plate, and outer block retaining nut means extending over a portion of the outer block means, threadably engaging the connecting pin means, and held by the connecting pin means in pressure contact against the outer block means to hold the outer block means against the mounting plate.

4. An electric terminal as defined by claim 3 wherein:

the retainer means defines a longitudinally extending aperture;

the connecting pin means extends through the aperture defined by the retainer means; and the connecting means further includes retainer nut means extending over a portion of the retainer means, threadably engaging the connecting pin means, and held by the connecting pin means in pressure contact against the retainer means to hold the retainer means against the outer block means.

5. An electric terminal as defined by claim 4 wherein:

the outer block means is comprised of a unitary element; and the connecting pin means extends upward through a central portion of the outer block means.

6. An electric terminal comprising:

a body;

a plurality of terminal pins longitudinally extending through the body;

a plurality of terminal nut means, each terminal nut means encircling and engaging an upper portion of a terminal pin and held by the pin in pressure contact against the body;

retainer means including a longitudinal portion and a transverse portion, the longitudinal portion defining a longitudinally extending aperture and extending between terminal pins to insulate electrically the pins from adjacent pins, the transverse portion extending over the terminal nut means for maintaining the terminal nut means and the terminal pins in place, and wherein the terminal pins longitudinally extend above the transverse portion of the retainer means to provide access to the terminal pins; and connecting means releasably connecting the retainer means to the body, and including connecting pin means extending upward from the body and through the aperture defined by the retainer means, retainer nut means engaging the connecting pin means and extending over a portion of the retainer means in pressure contact therewith to hold the retainer means against the body.

7. An electric terminal as defined by claim 6 further including:

a plurality of adapters connected to the terminal pins above the transverse portion of the retainer means to facilitate connecting the terminal pins to an electric current source; and spacer means extending through the transverse portion of the retainer means, between the terminal nut means and the adapters to maintain the adapters spaced from the transverse portion of the retainer means.

8. An electric terminal as defined by claim 7 wherein:

the retainer means comprises an integral element and the longitudinal portion thereof includes a central core, and a plurality of fins radially extending outward from the core between adjacent terminal pins.

9. An electric terminal as defined by claim 8 wherein the connecting pin means extends upward through the central core of the retainer means.

10. An electric terminal as defined by claim 9 wherein:

the retainer means includes indicia to identify individually the terminal pins;

the lower portion of a selected fin defines a recess; and the body includes a protrusion extending upward into the recess defined by the selected fin.

* * * * *